US011268257B1

(12) United States Patent
Leonardi et al.

(10) Patent No.: US 11,268,257 B1
(45) Date of Patent: Mar. 8, 2022

(54) SWIVEL BUCKET

(71) Applicant: Leonardi Manufacturing Co., Inc., Weedsport, NY (US)

(72) Inventors: Joseph Leonardi, Auburn, NY (US); Bruce C. Jordan, Auburn, NY (US)

(73) Assignee: Leonardi Manufacturing Co., Inc., Weedsport, NY (US)

( * ) Notice: Subject to any disclaimer, the term of this patent is extended or adjusted under 35 U.S.C. 154(b) by 0 days.

(21) Appl. No.: 17/090,503

(22) Filed: Nov. 5, 2020

Related U.S. Application Data

(60) Provisional application No. 62/930,918, filed on Nov. 5, 2019.

(51) Int. Cl.

| | |
|---|---|
| ***E02F 3/36*** | (2006.01) |
| ***E02F 3/65*** | (2006.01) |
| ***E02F 3/34*** | (2006.01) |
| ***E02F 3/40*** | (2006.01) |

(52) U.S. Cl.
CPC ..... *E02F 3/3677* (2013.01); *E02F 3/3417* (2013.01); *E02F 3/40* (2013.01); *E02F 3/651* (2013.01)

(58) Field of Classification Search
None
See application file for complete search history.

(56) References Cited

U.S. PATENT DOCUMENTS

| | | | | |
|---|---|---|---|---|
| 3,917,089 A * | 11/1975 | Eriksson | E02F 3/653 414/722 |
| 3,985,250 A * | 10/1976 | Mononen | B62D 49/065 414/725 |
| 4,207,022 A * | 6/1980 | Castel | E02F 3/3417 298/22 R |
| 5,706,591 A * | 1/1998 | Wissmiller | E01H 5/06 172/272 |
| 11,041,284 B2 * | 6/2021 | Fey | E02F 3/364 |

* cited by examiner

*Primary Examiner* — Ronald P Jarrett
(74) *Attorney, Agent, or Firm* — Bond Schoeneck & King, PLLC; George McGuire

(57) ABSTRACT

A bucket assembly for attachment to a machine, such as a skid steer or tractor, that includes a bucket and a mounting assembly that permits swiveling of the bucket about a vertical axis and pivoting of the bucket about a horizontal axis.

5 Claims, 23 Drawing Sheets

SWIVEL BUCKET

CROSS-REFERENCE TO RELATED APPLICATION

This application claims priority to U.S. Provisional Patent Application Ser. No. 62/930,918, filed on Nov. 5, 2019, and entitled "Swivel Bucket," the entire disclosure of which is incorporated herein by reference.

FIELD OF THE INVENTION

The present disclosure is directed generally to a pivoting bucket. Specifically, a bucket which can be attached to a machine and rotated along multiple axes.

BACKGROUND

Buckets are commonly used by people to move large amounts of material or heavy items. These buckets are often attached to machines such as skid steers, mini skid steers, tractors, or others. Some problems that conventional buckets have are they are not capable of moving in small spaces, they are not easily maneuverable, and they cannot be dumped into tall containers.

Conventional buckets can only move on the y-axis and the z-axis, meaning that they can only be moved up and down and be dumped. Therefore, when a user wants to be able to load the bucket from the left or the right or wants to dump the bucket to the left or the right the user has to move the entire machine to place the bucket into a different location. Most conventional buckets can only be dumped into container that are the height the machine extends, this is a problem for dumping into tall containers or trucks. While some buckets are capable of high dumping, they are not also capable of rotating.

Description of the Related Art Section Disclaimer: To the extent that specific patents/publications/products are discussed above in this Background Section or elsewhere in this Application, these discussions should not be taken as an admission that the discussed patents/publications/products are prior art for patent law purposes. For example, some or all of the discussed patents/publications/products may not be sufficiently early in time, may not reflect subject matter developed early enough in time and/or may not be sufficiently enabling so as to amount to prior art for patent law purposes. To the extent that specific patents/publications/products are discussed above in this Background Section and/or throughout the application, the descriptions/disclosures of which are all hereby incorporated by reference into this document in their respective entirety(ies).

SUMMARY

The present disclosure is directed to a swivel bucket.

To solve the above-mentioned problems the swivel bucket can be rotated along multiple axes, including the x-axis, y-axis, and the z-axis. The swivel bucket can be attached to a mini skid steer, regular skid steer, tractor, or another suitable device (as should be understood by a person of skill in the art in conjunction with a review of this disclosure). The swivel bucket can high dump, meaning that it can be dumped from a higher elevation than a regular or low dumping bucket. This allows for the contents of the bucket to be emptied into the back or trucks or taller containers. In one example, high dump is achieved by the attachment device being attached to the lower portion of the bottom of the bucket as opposed to the top of the bottom of the bucket.

The bucket is capable of moving on the x-axis, the y-axis, and the z-axis. This is better for collecting items and moving into smaller spaces. The rotation of the bucket allows the swivel bucket to move into smaller spaces, to be dumped at different spots, and to be loaded in varying ways all without the user moving the device in which the bucket is attached to. Typical buckets require movement of the entire device to move the position of the bucket.

According to an aspect is a bucket assembly for mounting to a machine, comprising a bucket defined by a floor having an inwardly and outwardly facing surfaces, a rear wall extending upwardly from the floor, opposing side walls each extending upwardly from the floor and connected along a rear edge to the rear wall, and an open front defined by the space between front edges of the opposing side walls, wherein the spacing between the front edges of the side walls is greater than the spacing between the rear edges of the side walls, and the floor grades downwardly from the rear wall towards the open front; a mounting assembly for mounting the bucket to the machine, comprising: a mounting plate adapted for secure attachment to the machine; a pivot plate extending in a plane and pivotally attached to the outwardly facing surface of the floor; a dumping mechanism extending between the outwardly facing surface of the floor and the pivot plate that is actuable to pivotally move the bucket about a horizontal axis between dumping and loading positions; a swivel mechanism attached to the pivot plate that is actuable to rotate the bucket about a vertical axis; and a bearing attached to the pivot plate that includes a longitudinal bearing axis extending therethrough.

According to an embodiment, the swivel mechanism comprises a piston and cylinder attached at a fixed end to the mounting plate and at an extendible/retractible end to the pivot plate, wherein extension or retraction of the cylinder causes rotation of the bucket about the longitudinal bearing axis.

According to an embodiment, the dumping mechanism comprises a piston and cylinder attached at a fixed end to the pivot plate and to an extendible/retractible end to the outwardly facing surface of the floor by a pin that extends along a pivot axis, wherein extension of retraction of the cylinder causes pivoting or the bucket about the pivot axis.

These and other aspects of the invention will be apparent from the embodiments described below.

BRIEF DESCRIPTION OF THE DRAWINGS

The present invention will be more fully understood and appreciated by reading the following Detailed Description in conjunction with the accompanying drawings, in which.

DETAILED DESCRIPTION OF EMBODIMENTS

The present disclosure describes a swivel bucket capable of movement relative to the x-axis, y-axis, and z-axis.

Figure 1:
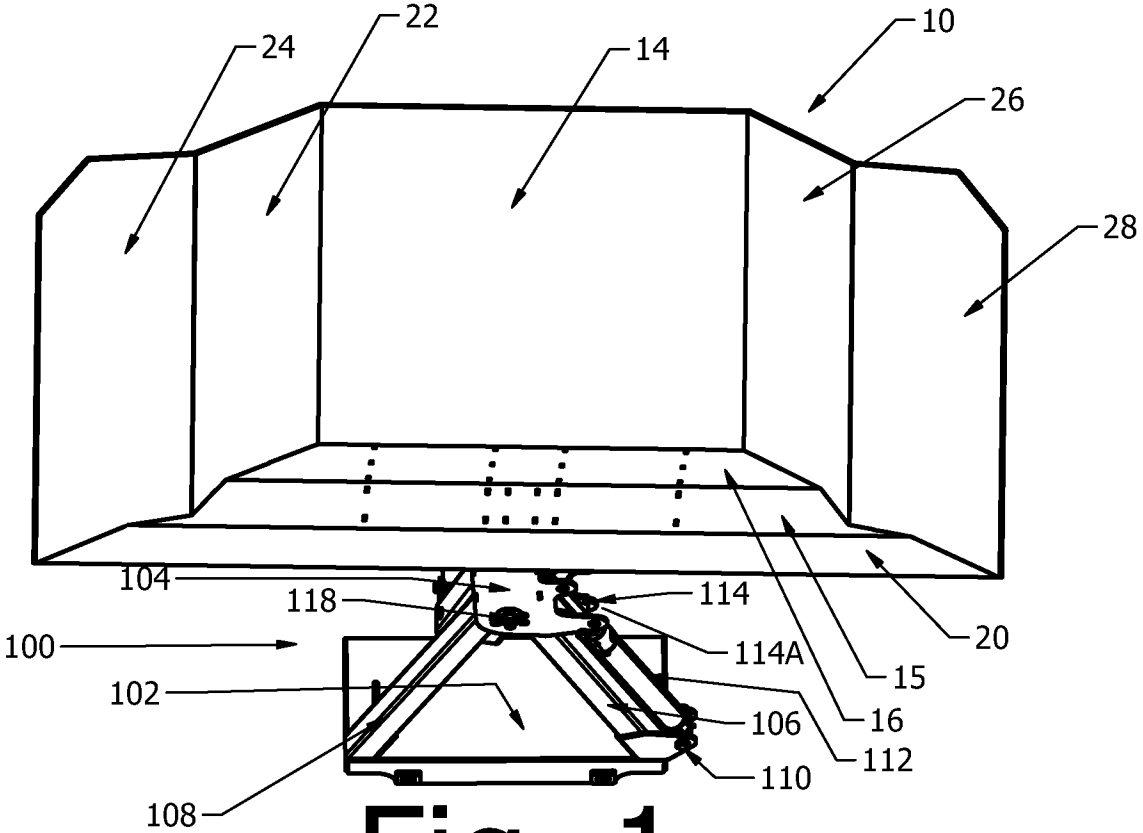
FIG. 1 is a front view of an example of a swivel bucket, in accordance with an embodiment.
Figure 2:
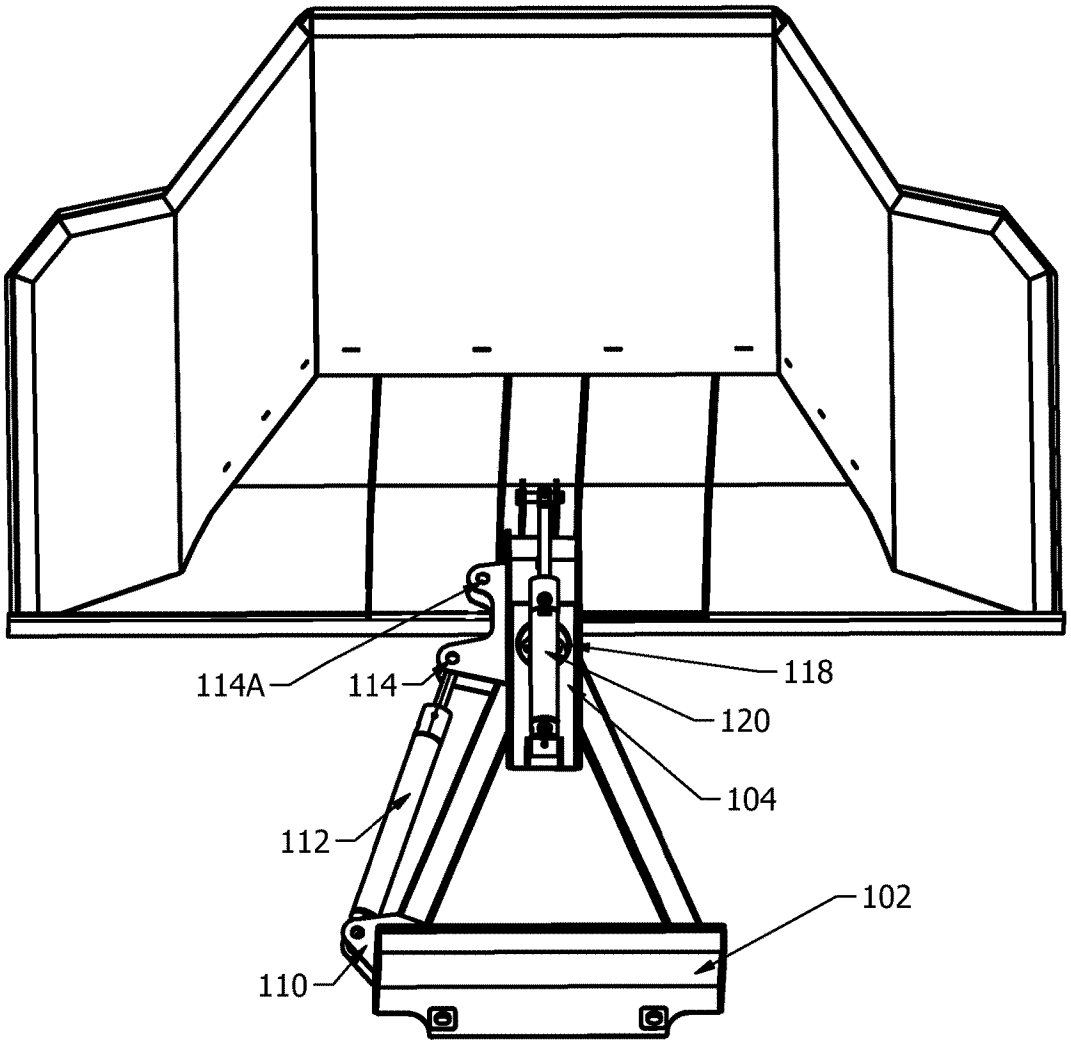
FIG. 2 is a back view of an example of a swivel bucket, in accordance with an embodiment.
Figure 3:
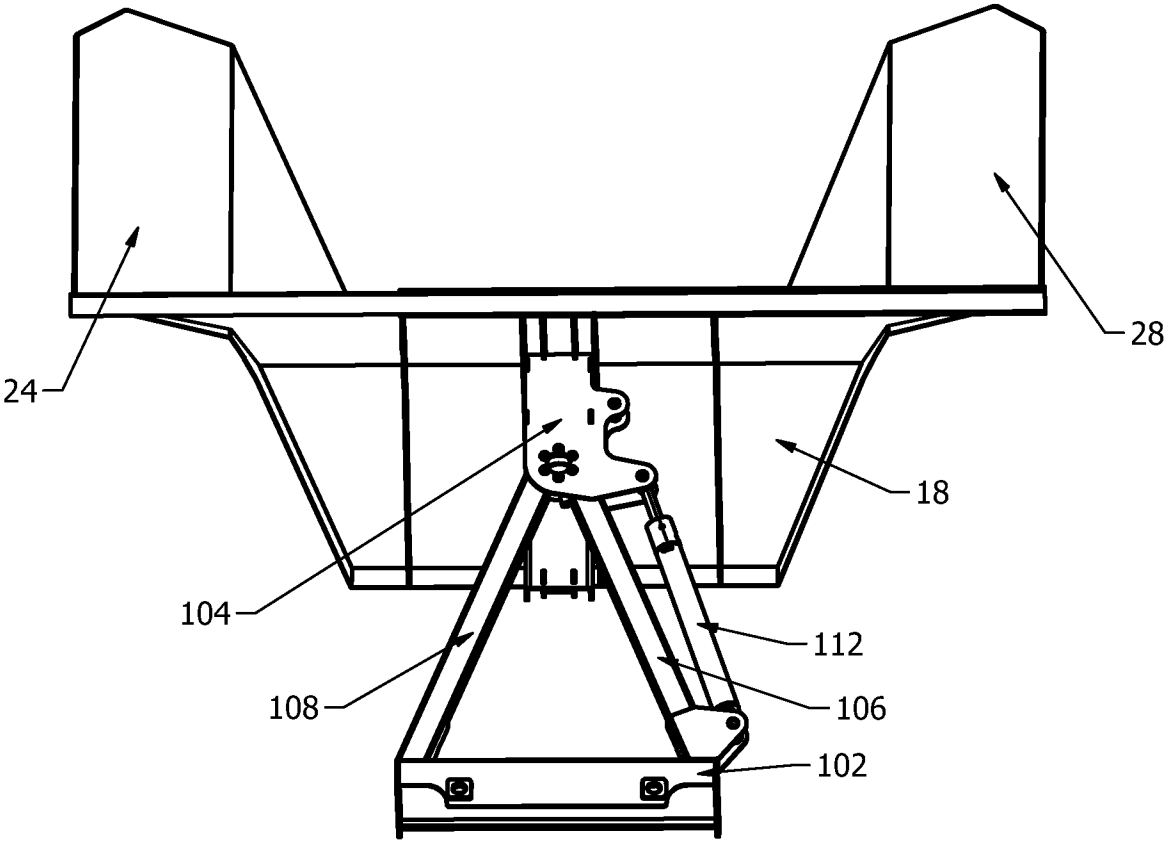
FIG. 3 is a bottom view of an example of a swivel bucket, in accordance with an embodiment.
Figure 4:
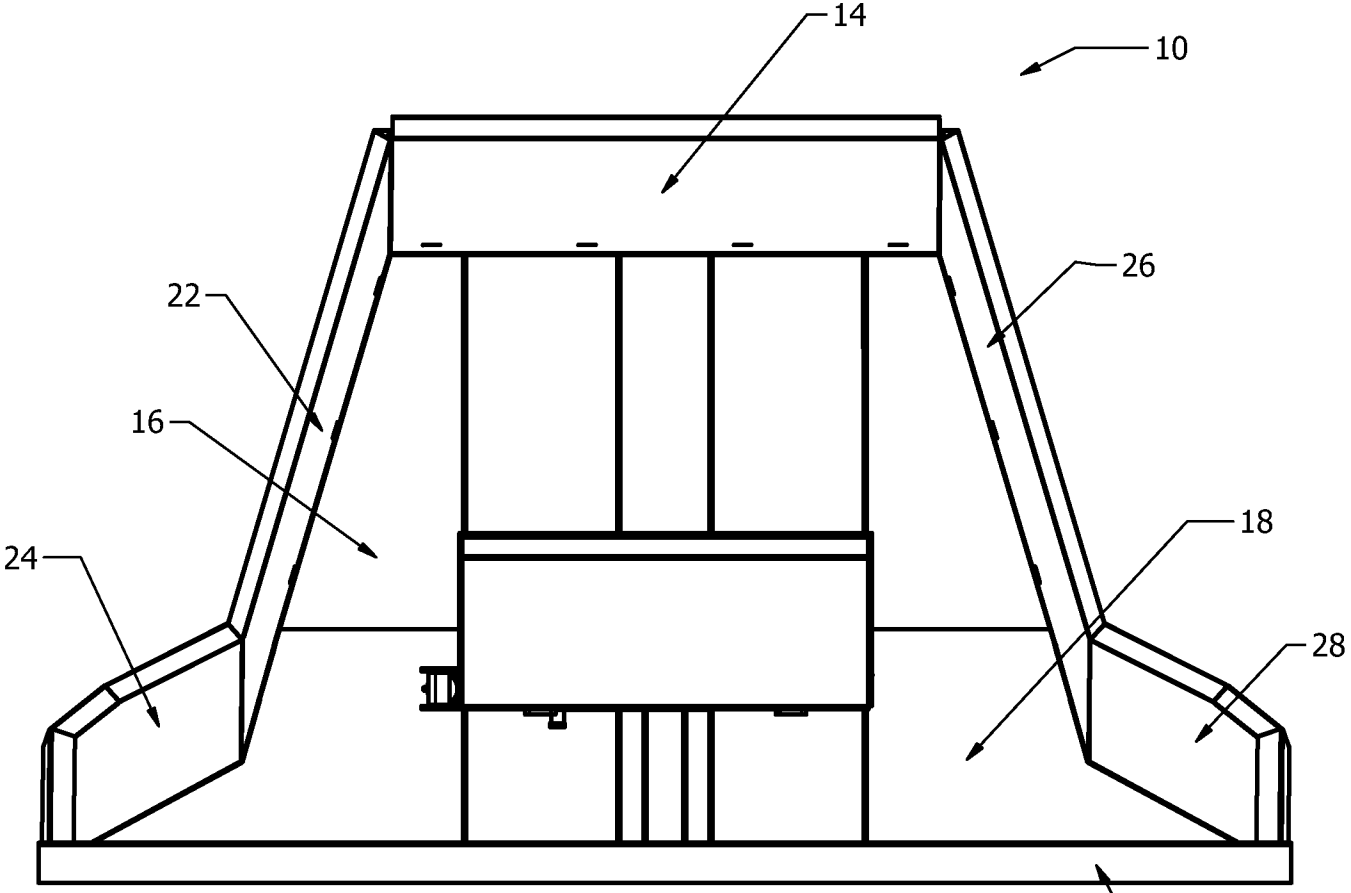
FIG. 4 is a bottom view of an example of a swivel bucket, in accordance with an embodiment.
Figure 5:
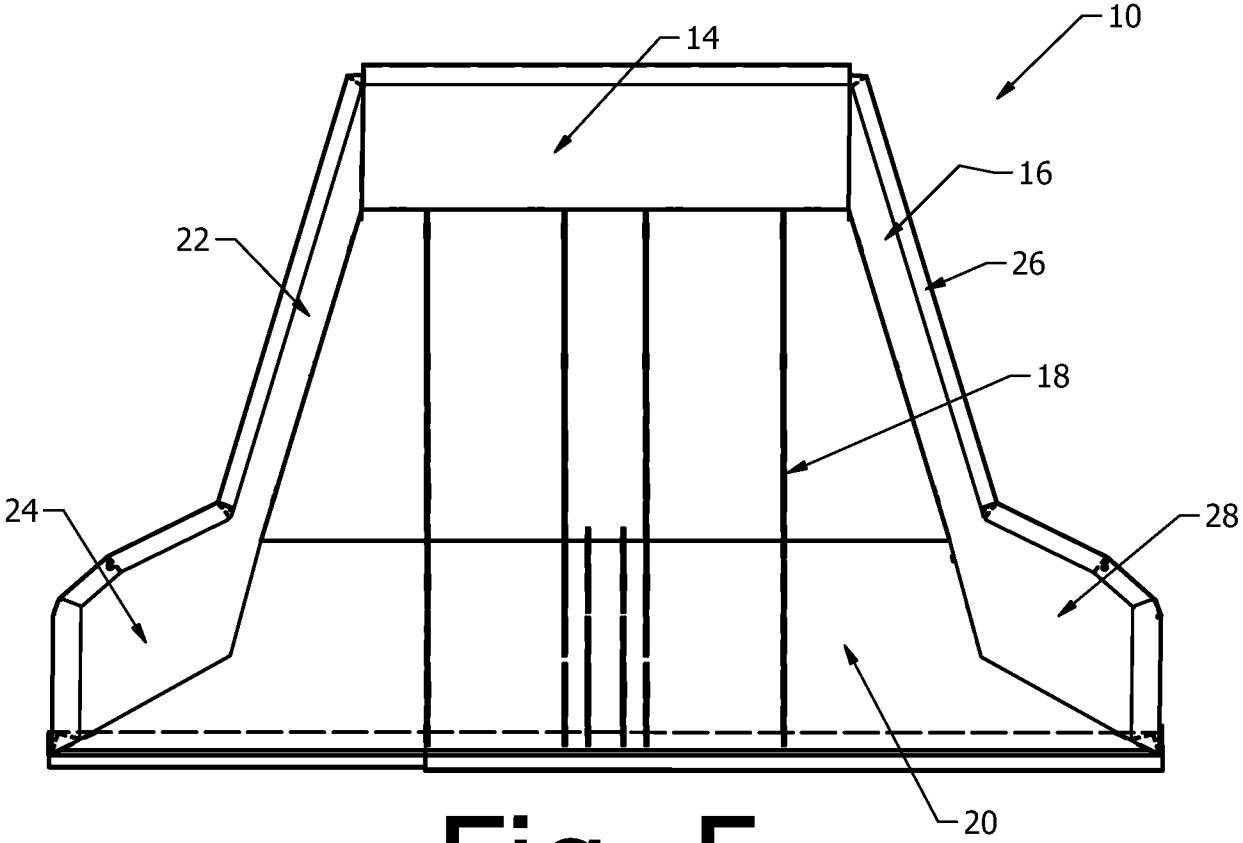
FIG. 5 is a top view of an example of a swivel bucket, in accordance with an embodiment.
Figure 6:
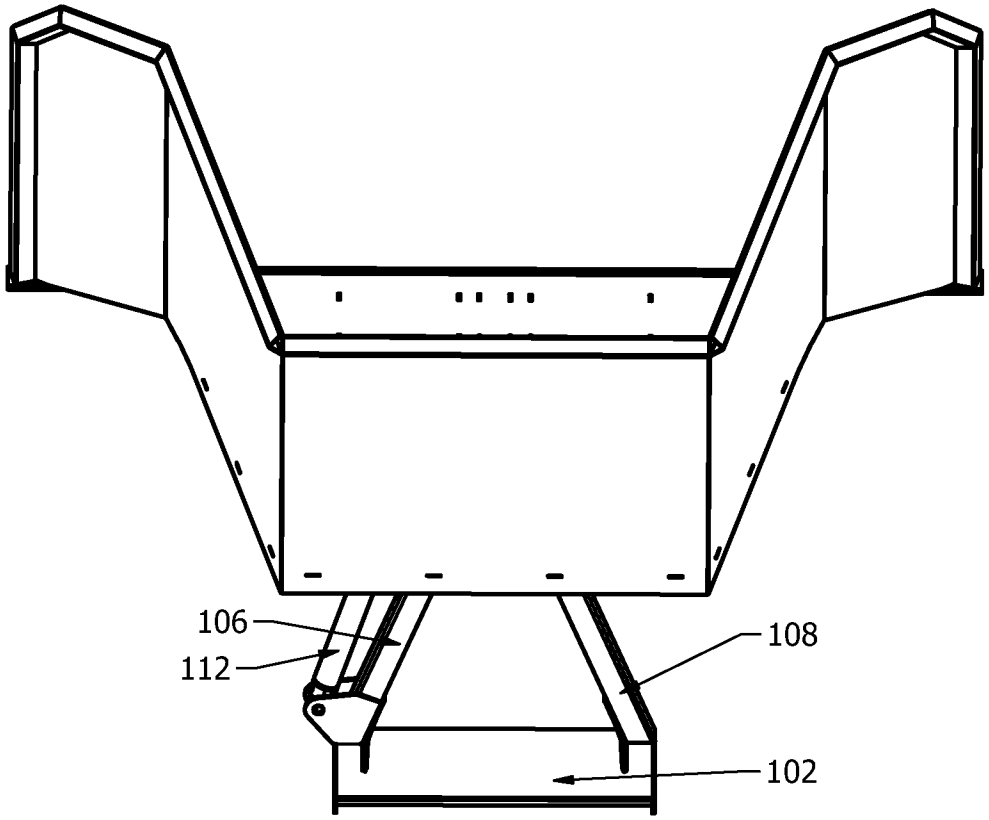
FIG. 6 is a perspective view of an example of a swivel bucket, in accordance with an embodiment.
Figure 7:
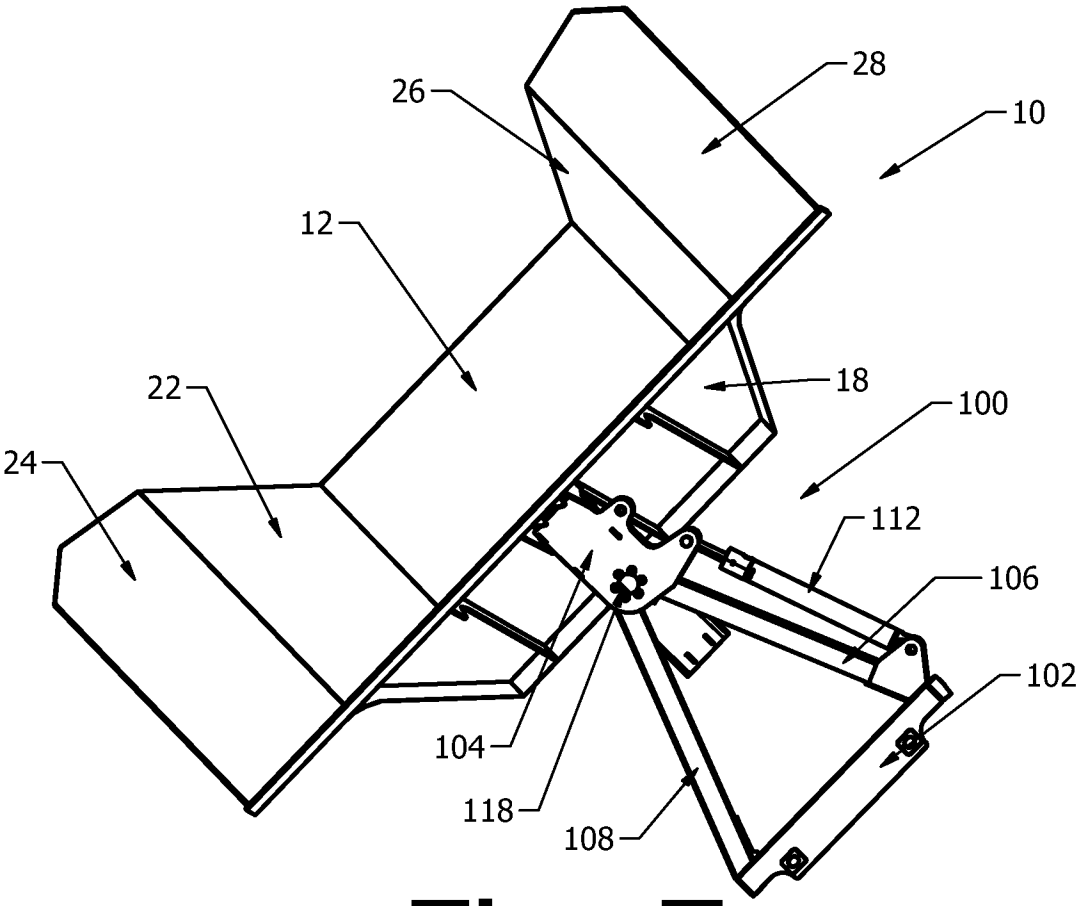
FIG. 7 is a perspective view of an example of a swivel bucket, in accordance with an embodiment.
Figure 8:
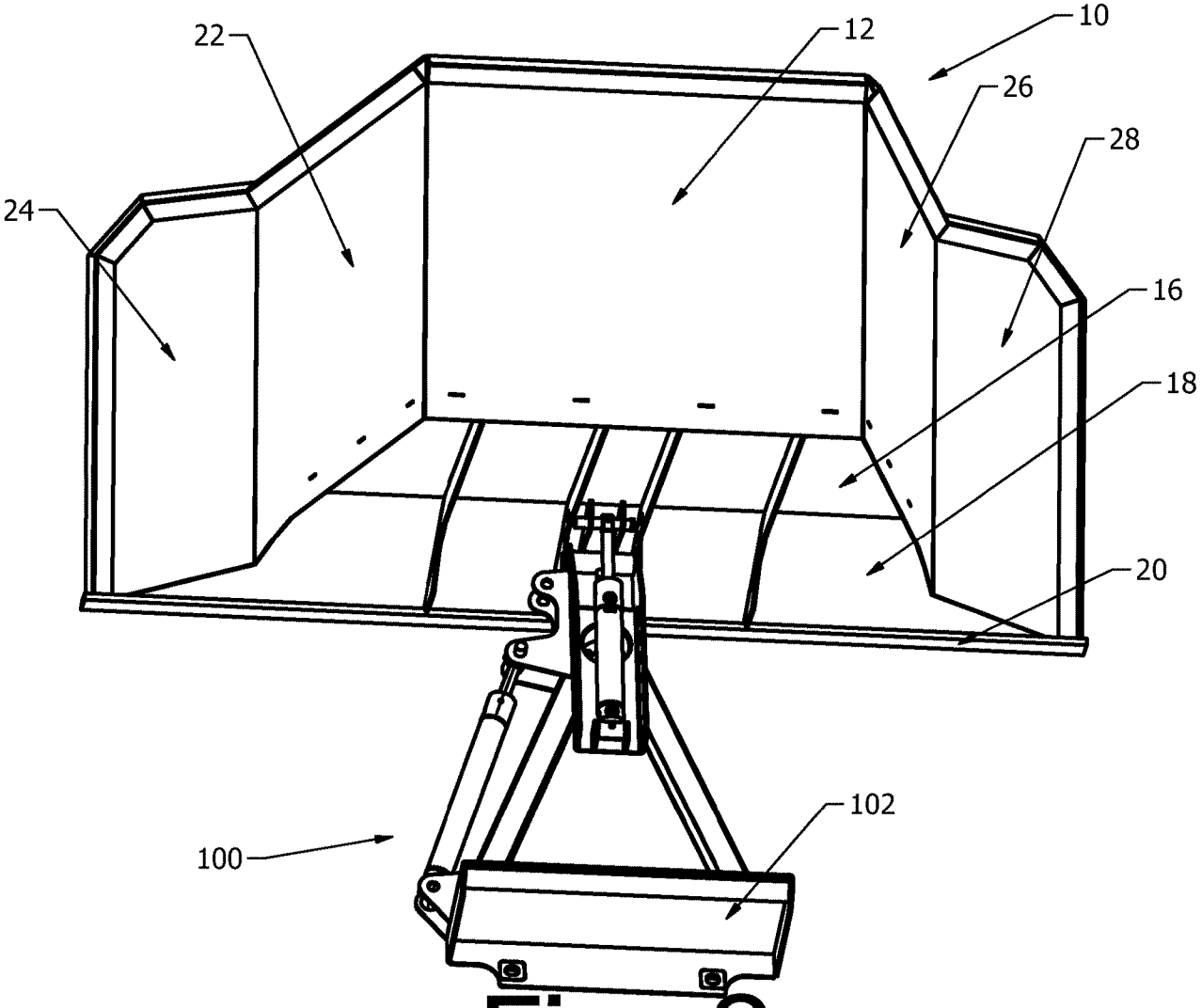
FIG. 8 is a perspective view of an example of a swivel bucket, in accordance with an embodiment.
Figure 9:
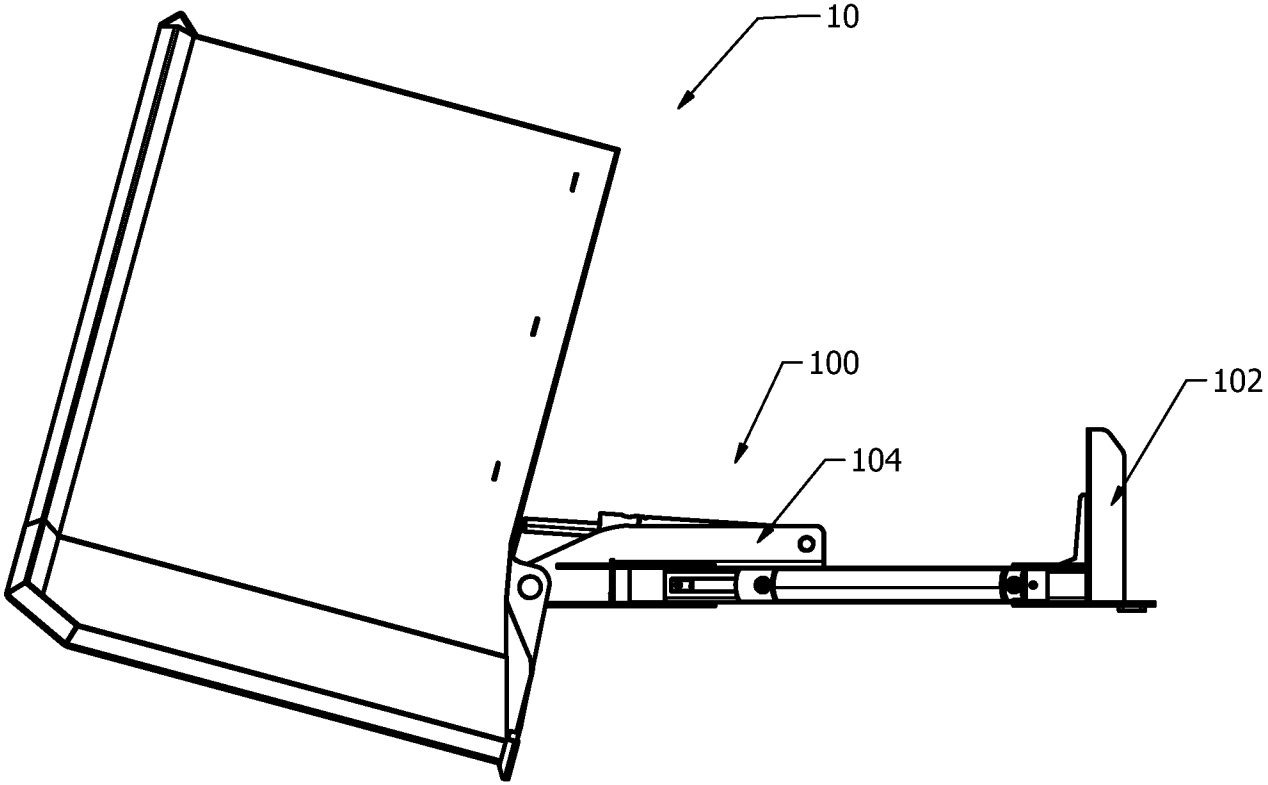
FIG. 9 is a side view of an example of a swivel bucket, in accordance with an embodiment.
Figure 10:
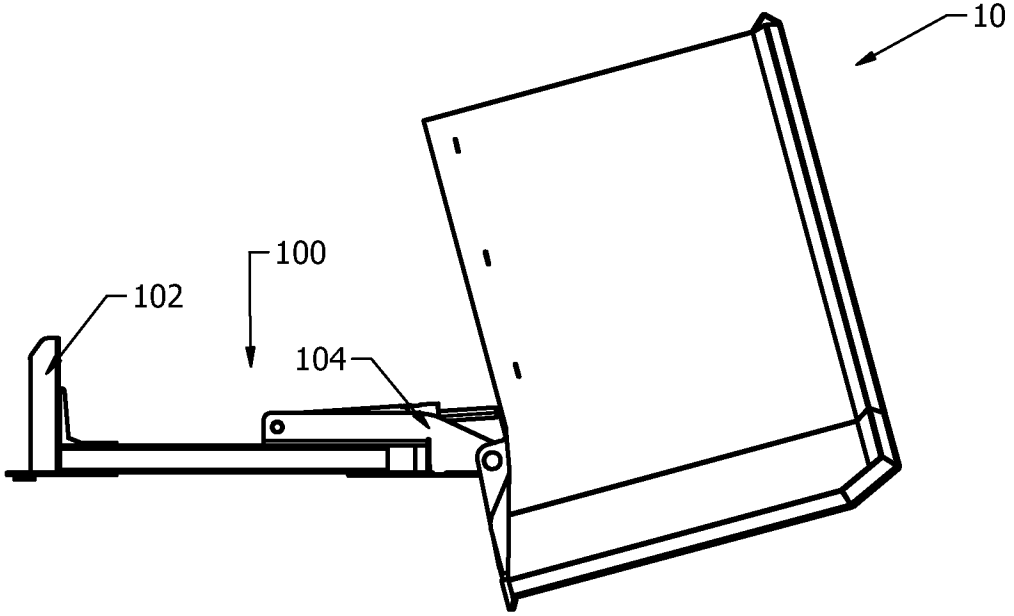
FIG. 10 is a side view of an example of a swivel bucket, in accordance with an embodiment.
Figure 11:
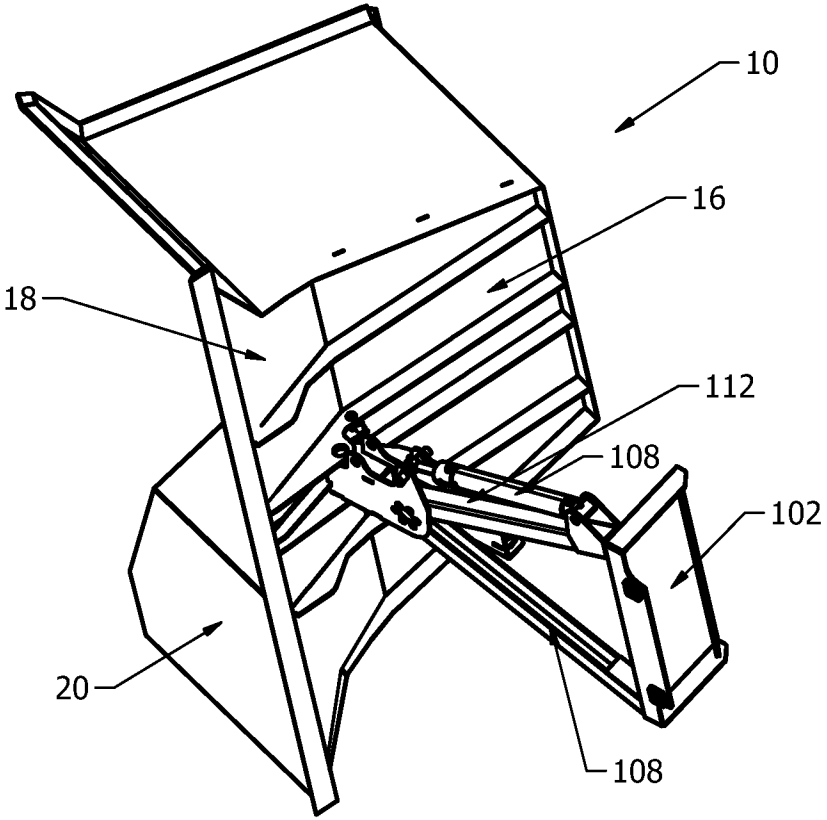
FIG. 11 is a perspective view of an example of a swivel bucket, in accordance with an embodiment.
Figure 12:
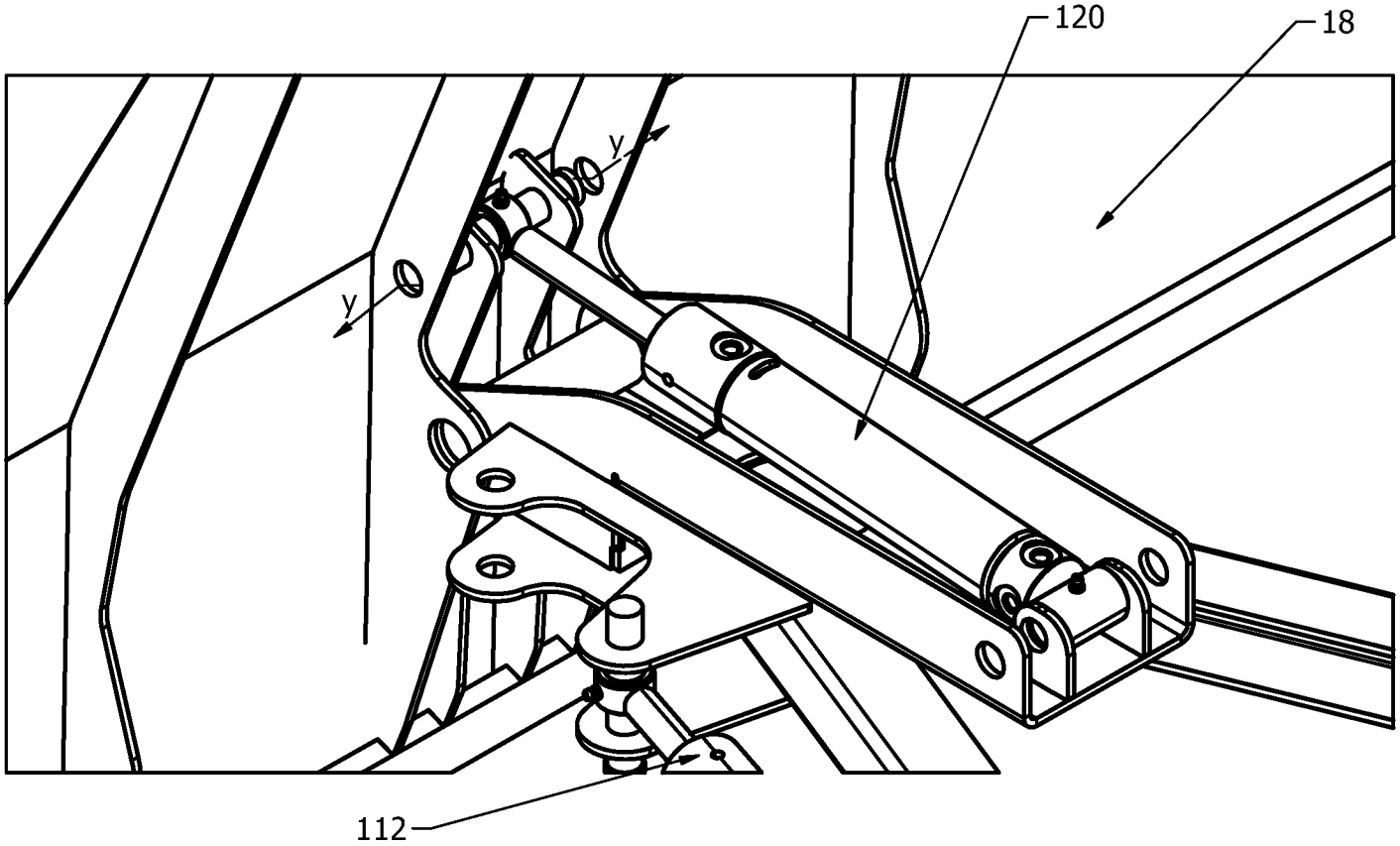
FIG. 12 is an enlarged bottom view of an example of a swivel bucket, in accordance with an embodiment.
Figure 13:
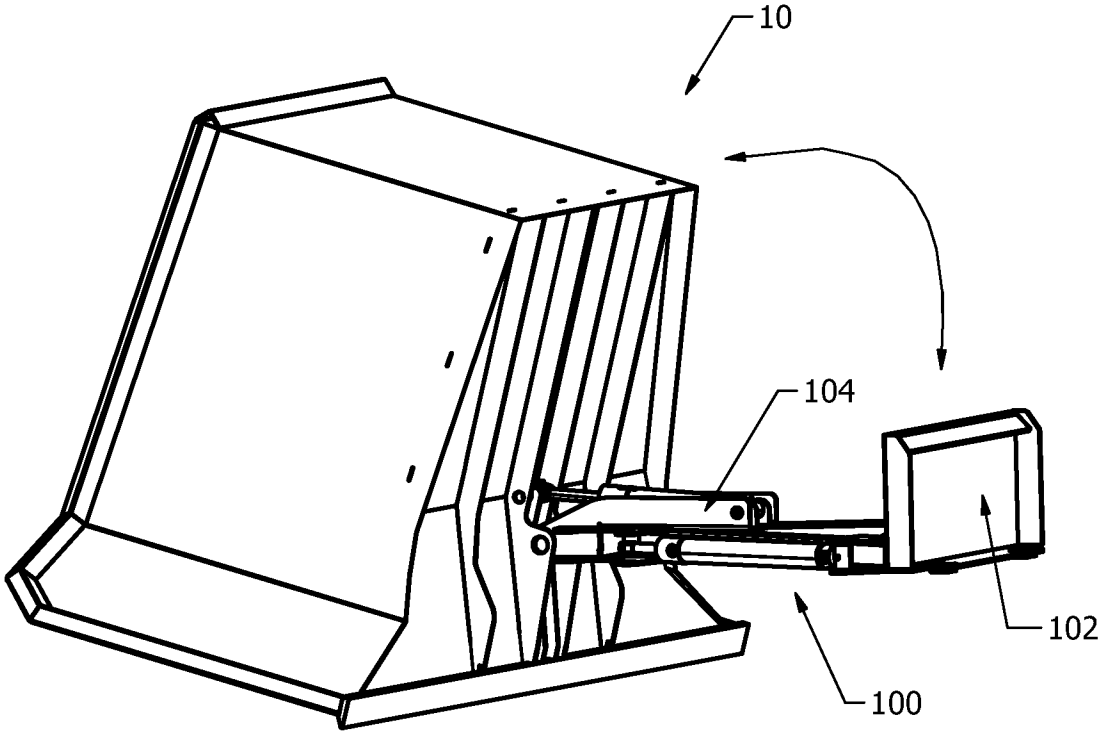
FIG. 13 is a perspective view of an example of a swivel bucket with arrows illustrating possible movement, in accordance with an embodiment.
Figure 14:
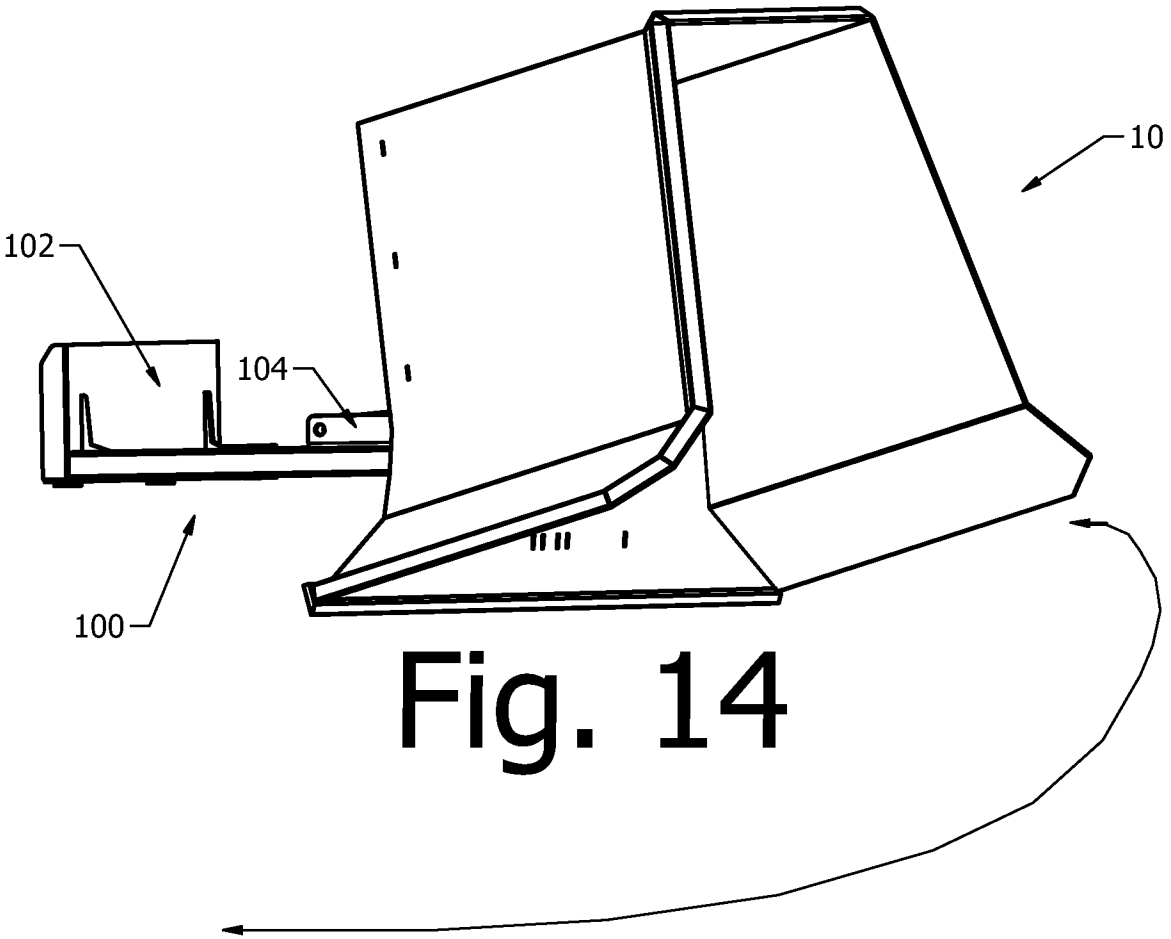
FIG. 14 is a perspective view of an example of a swivel bucket with arrows illustrating possible movement, in accordance with an embodiment.
Figure 15:
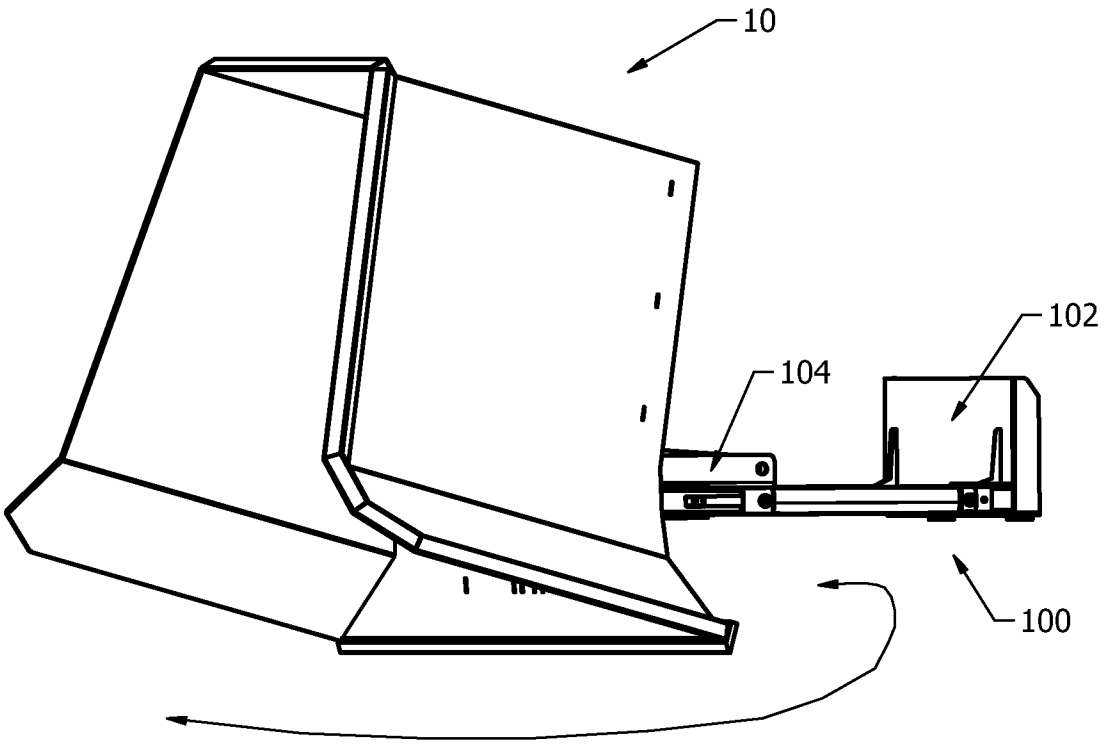
FIG. 15 is a perspective view of an example of a swivel bucket with arrows illustrating possible movement, in accordance with an embodiment.
Figure 16B:
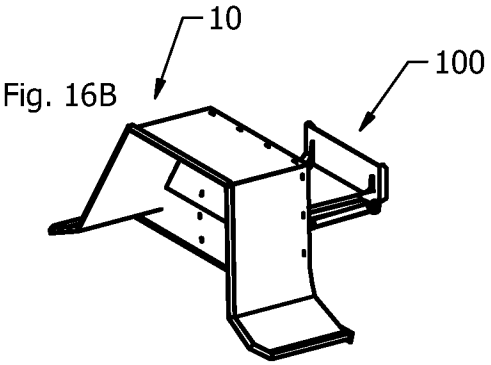
FIGS. 16A-16G are multiple elevation views of an example of a swivel bucket, in accordance with an embodiment.
Figure 16C:
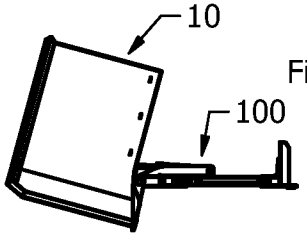
Figure 16G:
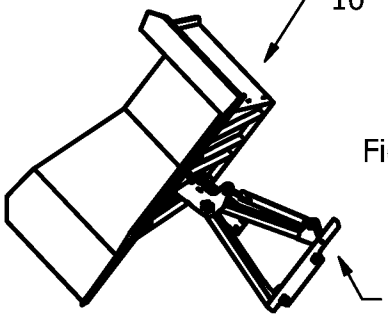
Figure 16A:
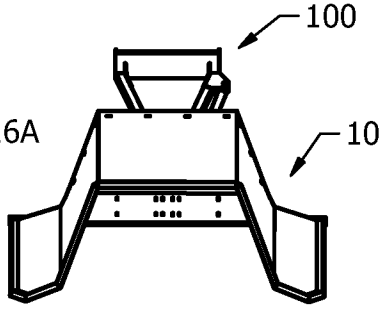
Figure 16D:
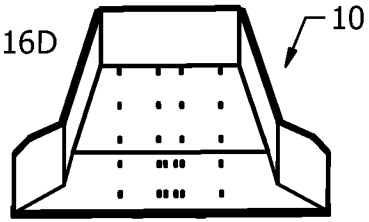
Figure 16F:
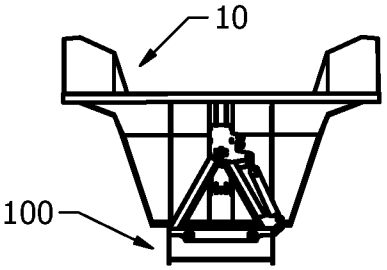
Figure 16E:
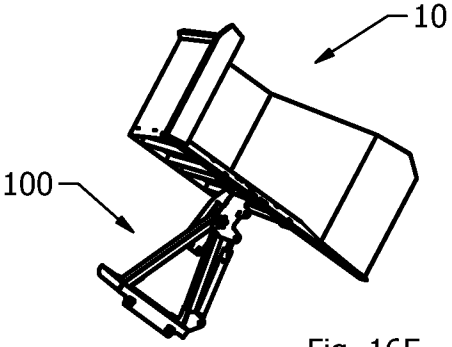
Figure 17C:
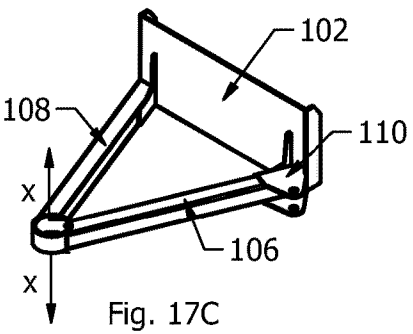
FIGS. 17A-17G are multiple elevation views of the mounting plate and rods of an example of the attachment device of a swivel bucket, in accordance with an embodiment.
Figure 17D:
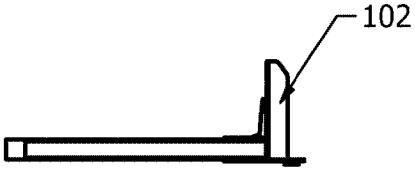
Figure 17B:
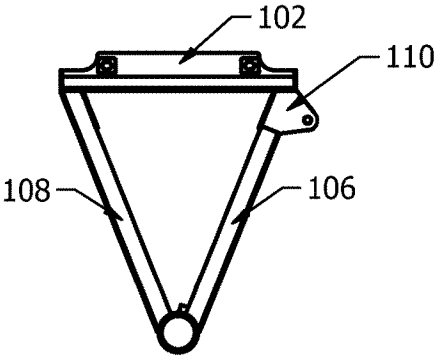
Figure 17E:
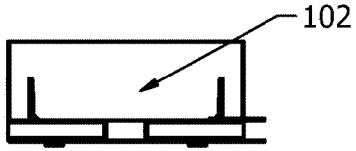
Figure 17A:
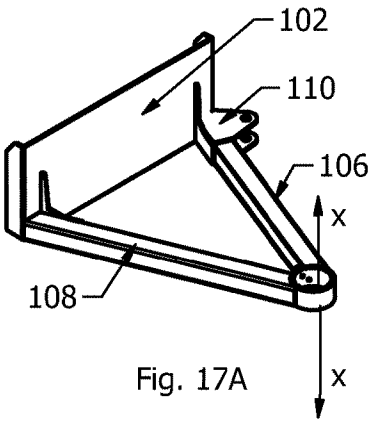
Figure 17F:
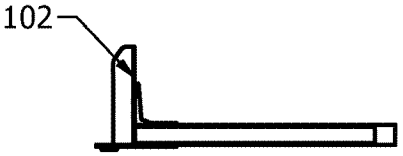
Figure 17G:
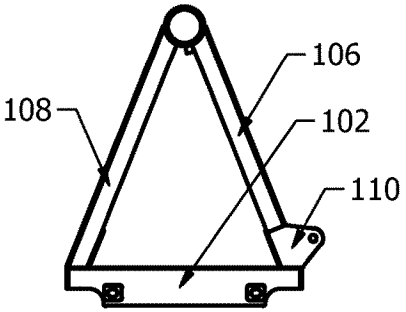
Figure 18A:
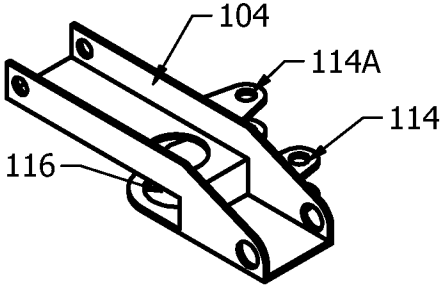
FIG. 18A-18E are multiple elevation views of the pivot plate and bracket of an example of an attachment device of a swivel bucket, in accordance with an embodiment.
Figure 18B:
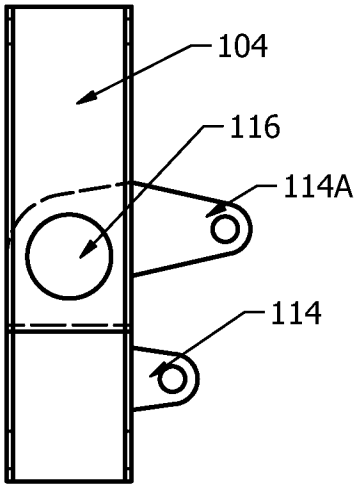
Figure 18C:
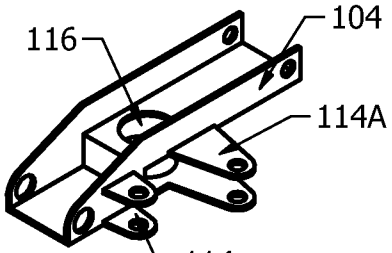
Figure 18D:
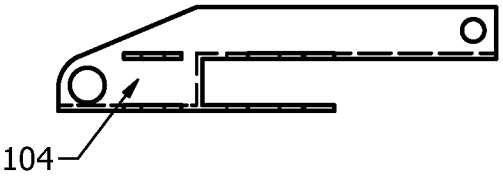
Figure 18E:
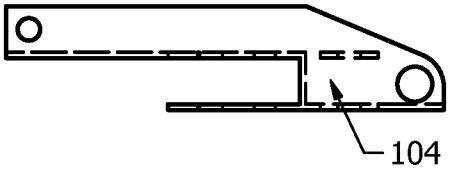
Figure 19:
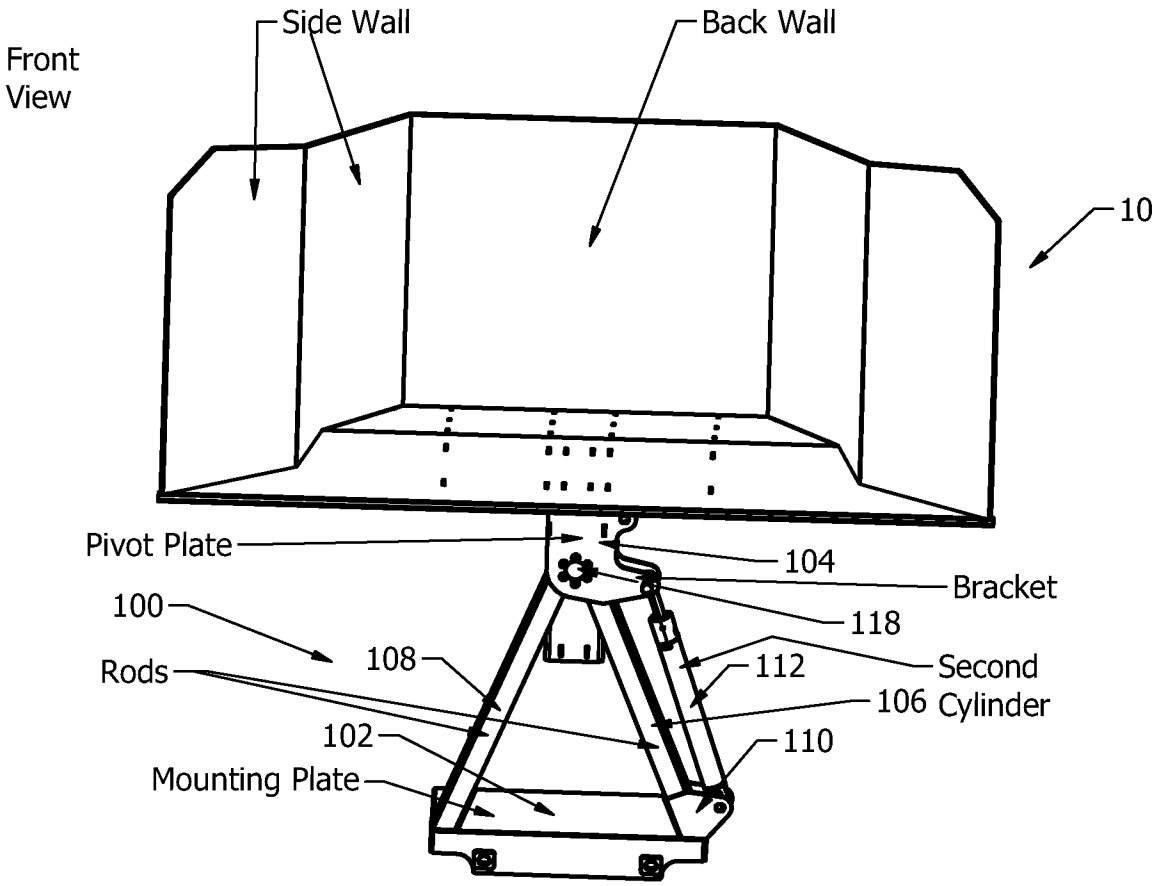
FIG. 19 is a labeled front view of an example of a swivel bucket, in accordance with an embodiment.
Figure 20:
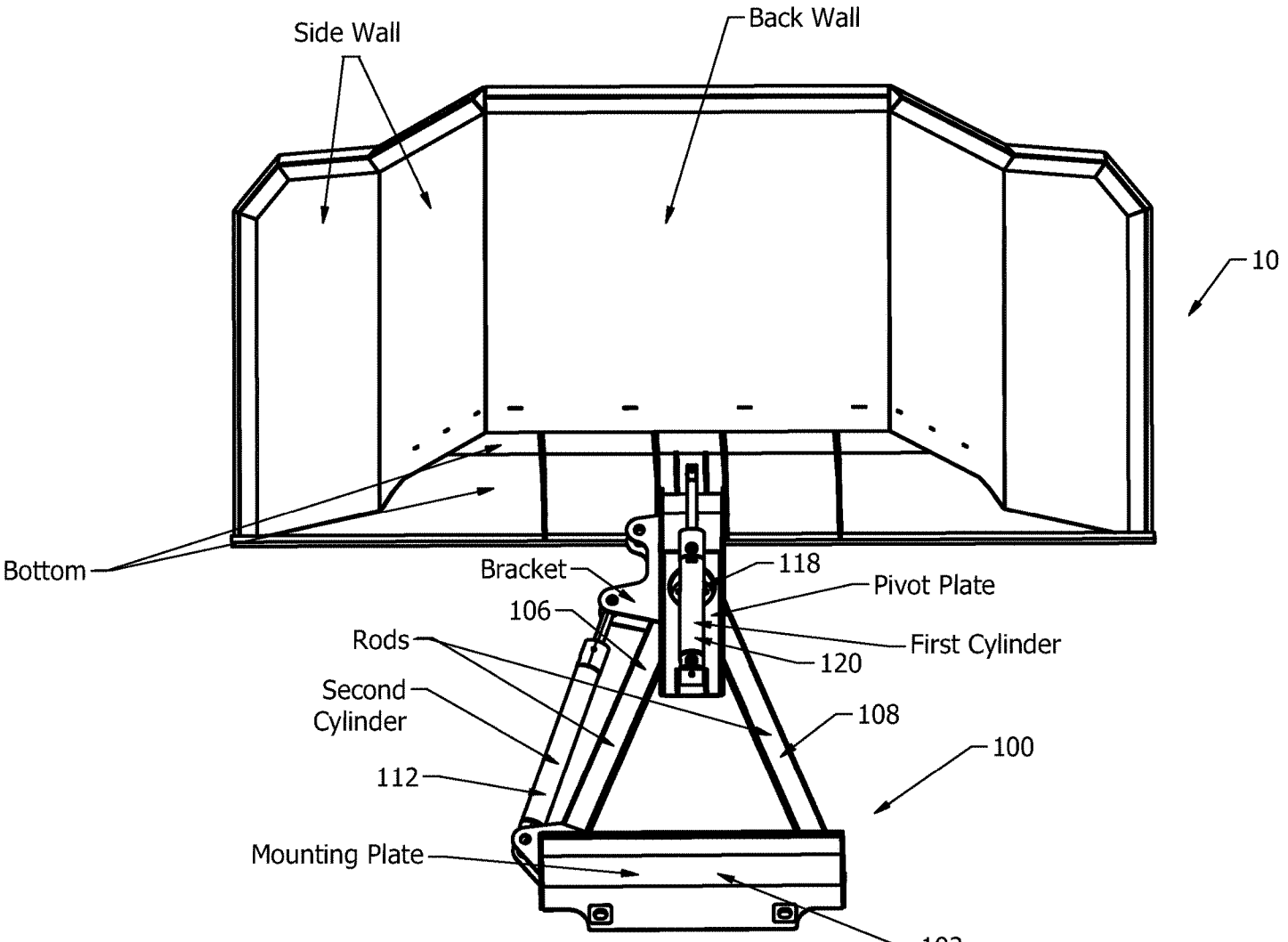
FIG. 20 is a back view of an example of a swivel bucket, in accordance with an embodiment.
Figure 21:
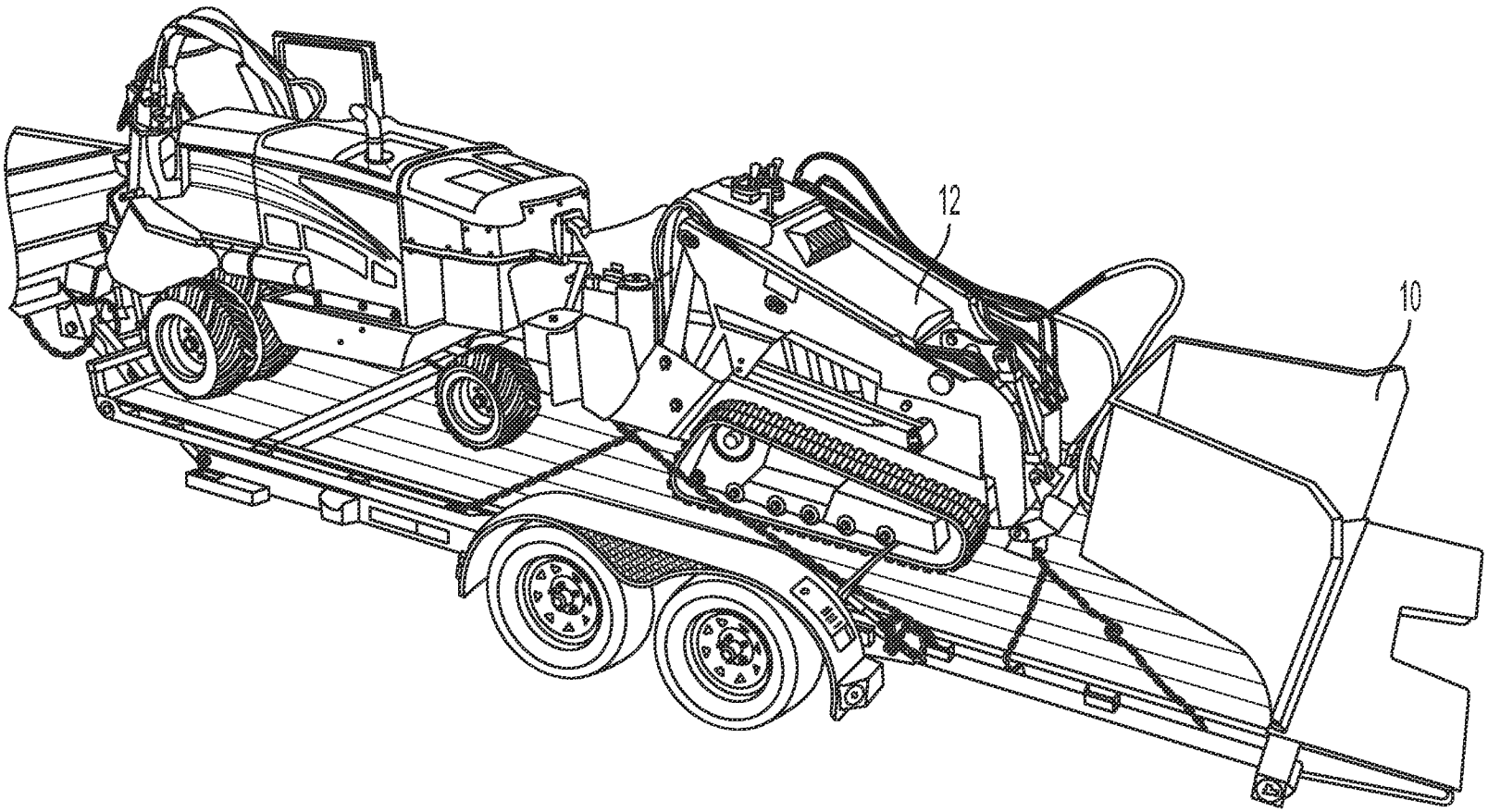
FIG. 21 is a perspective view of a machine having a swivel bucket mounted thereto, in accordance with an embodiment.
Figure 22C:
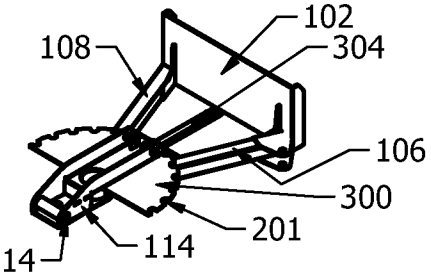
FIG. 22A-22F are multiple elevation views of notched plate, in accordance with an embodiment.
Figure 22E:
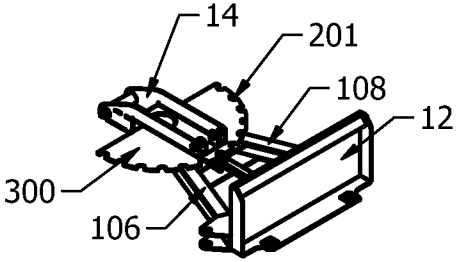
Figure 22B:
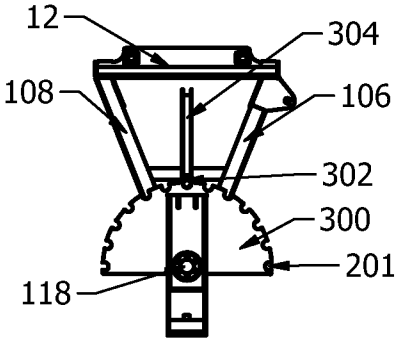
Figure 22D:
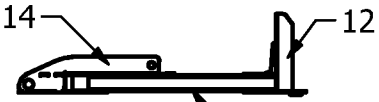
Figure 22A:
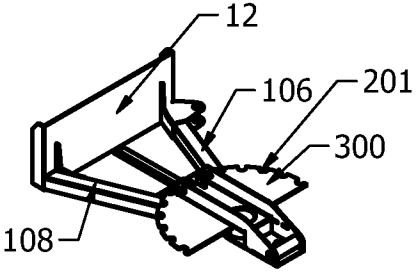
Figure 22F:
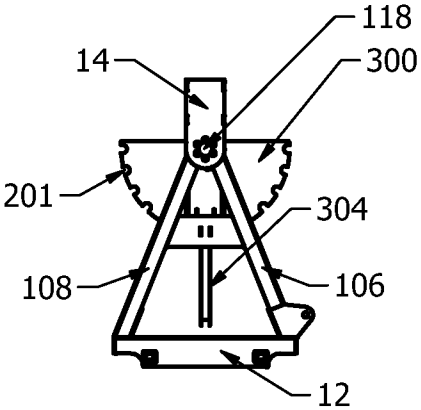

Referring to FIG. 21, in one embodiment, is a bucket 10 adapted for mounting to a machine 12 such as a tractor, skid steer, and the like by means of an attachment assembly, designated generally by reference numeral 100. Bucket 10 generally comprises a back wall 14, a floor comprising three panels 16, 18 and 20, opposing side walls each of which comprises two panels 22, 24, and 26, 28, respectively, and an open front 30.

Side wall panels 22 and 26 each extend forward from back wall 14, and side wall panels 24 and 28 extend forward from panels 22 and 26, respectively, and taper outwardly towards the open front 30. Thus, open front 30 is of a greater width than is the back wall 14. Floor panel 16 extends forward from the bottom of back wall 14, middle floor panel 18 extends forward from panel 16, and forward floor panel 20 extends forward from middle panel 18. Middle and forward floor panels 18 and 20 each slope downwardly, and the leading edge of forward panel 20 includes a scraping edge.

Attachment assembly 100 comprises a mounting plate 102 that is adapted to securely attach to machine 12 in a conventional manner and a pivot plate 104 that attaches to the outwardly facing surface of floor panel 18. Mounting plate 102 is attached to pivot plate 104 via a pair of diagonally extending braces 106, 108 that extend from the outer edges of the mounting plate 102 diagonally inwardly to pivot plate 104. Brace 106 includes a yoke (or ears) 110 to which one end of a piston/cylinder 112 is attached via a pin. The opposite end of piston/cylinder 112 (which is the end that retracts and extends) is pinned to a yoke 114 that is formed on pivot plate 104, thereby further interconnecting mounting plate 102 to pivot plate 104 (a second yoke 114A is provided as slight lateral distance from yoke 114 and could serve as the connection point and would permit a slightly greater degree of movement to be effected by piston/cylinder 112). Pivot plate 104 further includes an opening 116 formed therethrough and through which a bearing 118 is mounted; bearing 118 can absorb both thrust for when the bucket 10 is loaded, as well as permit rotation about the axis X-X that extends through opening 116. Mounting assembly 100 further comprises a second piston/cylinder 120 that has its fixed end pined to pivot plate 104 and its extendible/retractable end pinned to the outwardly facing surface of floor plate 18. Piston/cylinders 112 and 120 can be hydraulically driven, electrically driven solenoids, or any other form of extensible element known in the art.

In use, bucket 10 can be raised or lowered using the conventional lift arms on machine 12, and can then be rotated about axis X-X through control of piston/cylinder 112 that can extend or retract and in so doing, rotate the bucket about axis X-X (i.e., about the bearing 118). Once the angular position of bucket 10 is at a desired orientation, the bucket 10 can then be pivoted about the axis Y-Y that extends through the pin that connects retractable/extendible arm of piston/cylinder 120 to the floor plate 18. Through the spacing created by braces 106, 108, bucket 10 can also be lowered into engagement with the ground and/or raised to permit a high dumping of contents.

In another embodiment, instead of swiveling via piston/cylinder 112, that element can be replaced with a notched plate 200 (plate 200 has a series of notches 201 cut out in spaced intervals about its periphery) as shown in FIGS. 22A-22F. Notched plate 200 connects to pivot plate 104 and includes a pin 202 that can be moved into and out of engagement with any one of the notches formed around the perimeter of plate 200. In the embodiment shown, the plate 200 is semi-circular, but could form more or less of a circle as desired could permit rotation up to 360 degrees), but as shown permits rotation of up to 180 degrees. Pin 202 can be formed at the end of a rod 204 that can be manually or automatically moved towards and away from plate 200 to secure or release and permit the rotational positioning of bucket 10.

Figure 23:
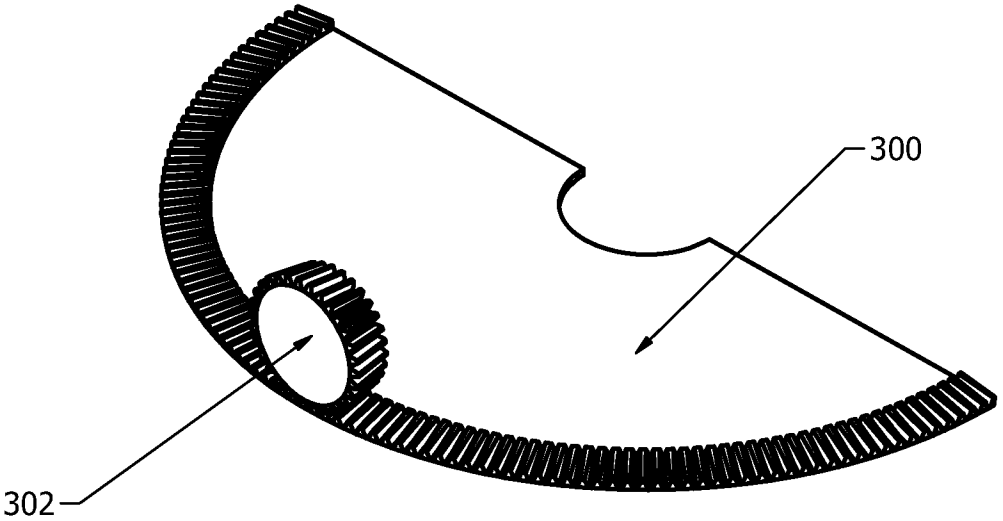
FIG. 23 is a perspective view of a gear arrangement, in accordance with an embodiment.

In another embodiment, as shown in FIG. 23 a gear 300 can be used in place of plate 200, and a drive gear 302 can be engaged with gear 300 used to effect rotation of bucket 10 about the axis X-X.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A bucket assembly for mounting to a machine, comprising:

a. a bucket defined by a floor having an inwardly and outwardly facing surfaces, a rear wall extending upwardly from the floor, opposing side walls each extending upwardly from the floor and connected along a rear edge to the rear wall, and an open front defined by a space between front edges of the opposing side walls;

b. a mounting assembly for mounting the bucket to the machine, comprising:

i. a mounting plate adapted for secure attachment to the machine;

ii. a pivot plate extending in a plane and pivotally attached to the outwardly facing surface of the floor;

iii. a dumping mechanism extending between the outwardly facing surface of the floor and the pivot plate that is actuable to pivotally move the bucket about a horizontal axis between dumping and loading positions;

iv. a swivel mechanism attached to the pivot plate that is actuable to rotate the bucket about a vertical axis; and v. a bearing attached to the pivot plate that includes a longitudinal bearing axis extending therethrough.

2. The bucket assembly according to claim 1, wherein the swivel mechanism comprises a piston and cylinder attached at a fixed end to the mounting plate and at an extendible/retractible end to the pivot plate, wherein extension or retraction of the cylinder causes rotation of the bucket about the longitudinal bearing axis.

3. The bucket assembly according to claim 1, wherein the dumping mechanism comprises a piston and cylinder attached at a fixed end to the pivot plate and to an extendible/retractible end to the outwardly facing surface of the floor by a pin that extends along a pivot axis, wherein extension of retraction of the cylinder causes pivoting or the bucket about the pivot axis.

4. The bucket assembly according to claim 1, wherein the space between the front edges of the side walls is greater than a space between rear edges of the side walls.

5. The bucket assembly according to claim 1, wherein the floor grades downwardly from the rear wall towards the open front.

* * * * *